United States Patent [19]

Stiner

[11] 4,223,288

[45] Sep. 16, 1980

[54] MANUALLY OPERABLE AND SHUNT CONTROLLABLE CIRCUIT BREAKER

[75] Inventor: Kent P. Stiner, Chadds Ford, Pa.

[73] Assignee: Gould Inc., Rolling Meadows, Ill.

[21] Appl. No.: 3,135

[22] Filed: Jan. 15, 1979

[51] Int. Cl.[3] ..... H01H 83/00

[52] U.S. Cl. ..... 335/20; 335/174

[58] Field of Search ..... 335/20, 16, 172, 174, 335/21, 35, 175, 164, 165, 155, 173

[56] References Cited

U.S. PATENT DOCUMENTS

| | | | |
|---|---|---|---|
| 4,164,719 | 8/1979 | Young et al. | 335/20 |
| 4,167,716 | 9/1979 | Horn | 335/20 |

*Primary Examiner*—Harold Broome

*Attorney, Agent, or Firm*—Harold Huberfeld

[57] ABSTRACT

A manually operable circuit breaker is provided with a spring powered trip-free contact operating mechanism. A fault current responsive thermal-magnetic automatic trip means is included as in an auxiliary means for operation of the circuit breaker from a remote location. Both the auxiliary means and the operating mechanism operate to open and close the same set of contacts.

10 Claims, 2 Drawing Figures

MANUALLY OPERABLE AND SHUNT CONTROLLABLE CIRCUIT BREAKER

This invention relates to manually operable circuit breakers in general and more particularly relates to circuit breakers of this type which may be both opened and closed from a location remote from the circuit breaker.

Notwithstanding sharply rising costs for producing electrical energy, the demand for electricity continues to increase, with demand often exceeding existing generating capacity. Ocassionally, excessive demand has caused generating system breakdowns resulting in complete deenergization of large blocks of consumers. In other instances, excessive demand has been handled by reducing system voltage. The latter is unsatisfactory in that some equipment functions poorly or ceases to function entirely in the absence of full voltage availability.

In order to obviate the necessity for expanding generating capacity to meet peak electrical demands of relatively short duration, it has been proposed that power generating companies be provided with the capability of load management or load shedding independently of control by the customers. That is, apparatus is provided which permits a power company to deenergize selective loads of certain customers without interrupting electrical service to more critical loads. Typically, the load that is interrupted during high demand periods is a non-critical home appliance such as an electric water heater or an air conditioner. One method for achieving the foregoing type of load management is to utilize a contactor connected in series with the circuit breaker through which the appliance in question is energized. The contactor is biased to closed circuit position and is operated electromechanically to open circuit position by a control signal which the utility generates at a location remote from the contactor.

According to the instant invention, solenoid operating means is utilized for remote control of the circuit breaker contacts forming part of a conventional circuit breaker mechanism. The circuit breaker includes a trip-free spring powered operating mechanism and an automatic fault current responsive trip means, both of which are free to operate in the conventional manner notwithstanding the inclusion of a remotely controlled solenoid means. More particularly, the circuit breaker is of a type in which the trip-free mechanism includes a releasable cradle normally held in latched position and releasable by automatic trip means. An operating spring is connected to a movable contact arm which is pivotally mounted on a pivoted manually operable member. With the circuit breaker contacts closed, if the shunt operated solenoid is energized the plunger thereof is projected to engage the movable contact arm and open the circuit breaker contacts while the manual operating handle of the circuit breaker remains in the On position. As long as the solenoid plunger remains in its projected position the circuit breaker contacts cannot be closed. When it is no longer necessary to maintain the circuit breaker open, a remotely generated signal is utilized to release a latch means that permits the solenoid plunger to move to its retracted position thereby permitting closing of the circuit breaker contacts.

Accordingly, a primary object of the instant invention is to provide novel apparatus for management of electrical loads from a location remote from circuit breakers controlling energization of the load.

Another object is to provide novel load management apparatus that is readily mountable in conventional panelboards in locations designed for conventional circuit breakers.

Still another object is to provide load management apparatus of this type which includes a conventional trip-free spring powered contact operating mechanism and a remotely operated solenoid for opening and/or preventing the closing of circuit breaker contacts.

A further object is to provide load management apparatus of this type which does not require standby power to maintain the apparatus either opened or closed.

These objects as well as other objects of this invention shall become readily apparent after reading the following description of the accompanying drawings in which.

Figure 2:
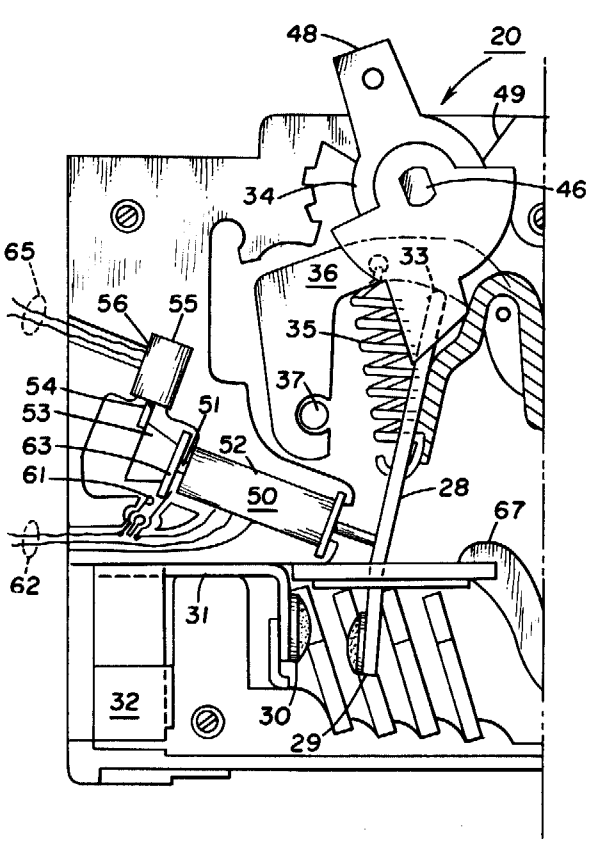
FIG. 2 is a fragmentary portion of the apparatus of FIG. 1 with the contacts held open by the remotely controlled solenoid.
Figure 1:
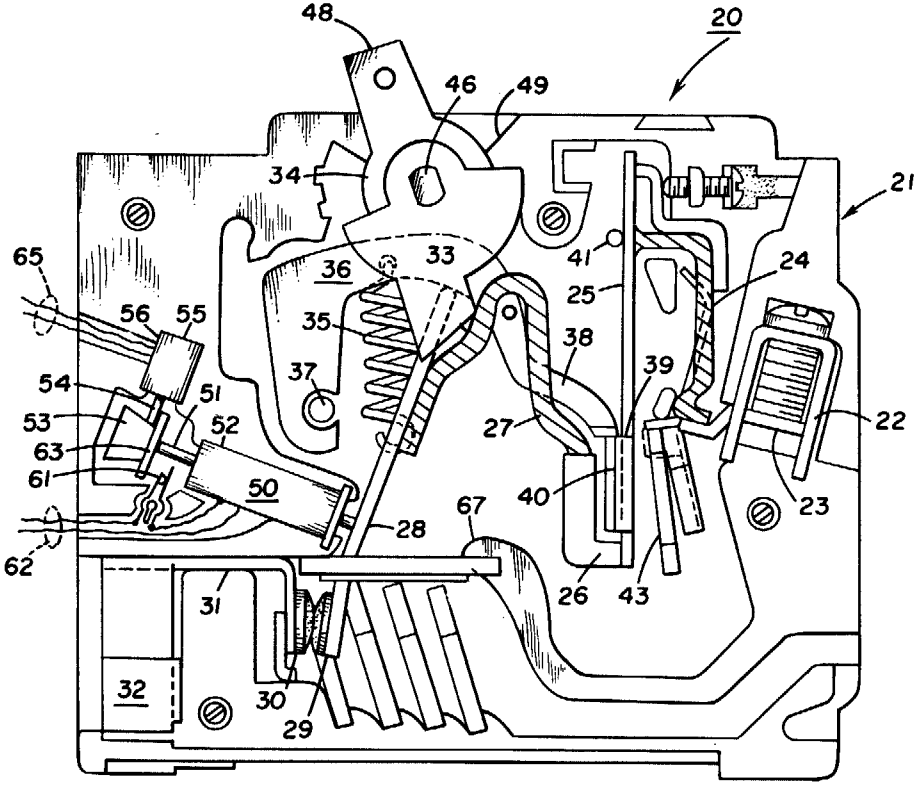
FIG. 1 is a side elevation of load management apparatus constructed in accordance with teachings of the instant invention, with the near section of the housing removed to permit clear viewing of the internal elements. In this FIG. 1 the load management apparatus is closed.

Now referring to the Figures. Load management circuit breaker 20 includes relatively narrow housing 21, say 1" wide, only the far section of which is shown in FIGS. 1 and 2. The main current path through circuit breaker 20 includes wire grip 22 at one end of load terminal 23 whose other end is connected by conducting braid 24 to one end of bimetal 25, through bimetal 25 to L-shaped strap 26 at the other end thereof, through strap 26 and flexible braid 27 which connects strap 26 to movable contact arm 28 which connects movable contact 29 cooperating with stationary contact 30, through the latter, and through conducting strap 31 connecting stationary contact 30 to female type plug-in line terminal 32. The conventional mechanism for operating movable contact 29 is described in detail in the C. E. Gryctko U.S. Pat. No. 3,369,202 issued Feb. 13, 1968 for a Circuit Breaker Stack Including Auxiliary Features.

More particularly, the end 33 of contact arm 28 remote from movable contact 29 engages a pivot abutment formation formed on the confronting surfaces of bifurcated sections of operating member 34. Coiled tension spring 35 extends between intermediate portions of movable contact arm 28 and releasable cradle 36. The latter is pivotally mounted on housing embossment 37. The end of cradle 36 remote from pivot 37 is formed as a latching tip 38 engagable with latching surface 39 of latch member 40 mounted near one end of bimetal 25. Member 40 constitutes a generally U-shaped magnet movable toward relatively stationary yoke 43 when fault current of sufficient magnitude flows through bimetal 25. Operating member 34 is provided with aligned transverse projections 46 which are received by aligned apertures (not shown) in housing 21 to pivotally support member 34. The latter also includes manually engagable extension 48 which projects outwardly from housing 21 through front opening 49 thereof.

The portion of circuit breaker 20 described up to this point is of conventional construction wherein manual operation of operating member 34 is effective to bring movable contact 29 into and out of engagement with cooperating stationary contact 30. In addition, upon the occurrence of predetermined overload conditions of relatively low magnitude bimetal 25 will heat and the free end thereof will deflect to the right with respect to FIG. 1 moving latching surface 39 away from latching tip 38 to release cradle 36 for automatic opening of contacts 29, 30 under power stored in main spring 35. A similar automatic tripping operation takes place upon the occurrence of higher predetermined overload currents which are sufficient to cause magnet 42 be attracted by yoke 43 thereby moving latching surface 39 to the right with respect to FIG. 1 and releasing cradle 36.

Auxiliary means in the form of solenoid 50 is provided to operate movable contact 29 from a remote location. More particularly, solenoid 50 includes plunger or armature 51 which extends through coil 52. When the latter is energized, armature 51 moves axially to the right with respect to FIG. 1 projecting from the right end of coil 52, as seen in FIG. 2. In moving to the latter position armature 51 engages movable contact arm 28 and separates movable contact 29 from stationary contact 30. When armature 51 reaches the end of its travel to the right with respect to FIG. 1 the conical formation 53 at the left end of armature 51 moves to the right of latch 54 which is biased outwardly from coil 56 of latch release solenoid 55. Latch 54 then assumes the blocking position shown in FIG. 2 and prevents armature 51 from moving to the left when coil 52 is deenergized, even though main spring 35 acting through movable contact arm 28 exerts a biasing force on armature 51 acting to the left with respect to FIG. 2.

Normally closed switch 61 is connected in series with one of the control leads 62 through which control signals for energizing solenoid 50 are applied to coil 52 thereof when armature 51 is latched in the active position of FIG. 2 radial projection 63 thereon and open switch 61 by engaging one of the spring arms thereof. This prevents overheating of solenoid 50.

Latch 54 is an axial extension of the armature (not shown) surrounded by operating coil 56 of solenoid 55. Coil 56 is energized from a remote location by control signals applied on control leads 65. Energization of solenoid 55 retracts latch 54 permitting armature 51 to move to the left with respect to FIG. 2 under the influence of main spring 35.

It is noted that the separation of contacts 29, 30 under the action of auxiliary means solenoid 50 is less than the separation between contacts 29, 30 brought about through the operation of the circuit breaker operating mechanism 34, 35, 36, etc. On opening, the latter pivots movable contact arm 28 counterclockwise until arm 28 engages internal housing abutment 67. The smaller opening is tolerable for contact operation by solenoid 50 in that it is assumed that only normal operating current will be flowing when solenoid 50 is energized. If overload conditions exist the thermal-magnetic trip means 25, 26, 43 will release latch 39 and there will be full contact separation. It is also noted that even when contacts 29, 30 are in the fully open position, solenoid 50 may be operated to project armature 51 to the right to the position in FIG. 2. Subsequent manual operation of member 34 will be ineffective to close contact 29, 30 in that the projecting armature 51 will block clockwise movement of movable contact arm 28 past the position shown in FIG. 2.

Thus, it is seen that the instant invention provides a compact circuit breaker having a single set of main circuit contacts which are separated automatically upon the occurrence of predetermined fault current conditions and may be selectively operated from signals generated at locations remote from the circuit breaker.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A circuit breaker including a cooperating contact means, a manually operable overcenter spring-type operating mechanism for opening and closing said contact means, automatic trip means operatively connected to said operating mechanism and operative responsive to predetermined fault current conditions to actuate said operating mechanism for opening said contact means, auxiliary means including a first section operable independently of said operating mechanism and said trip means to open said contact means responsive to a first control signal generated remote from said circuit breaker.

2. A circuit breaker contact as set forth in claim 1 in which the first section of the auxiliary means is operable from a first to a second position upon receipt of the first control signal, said auxiliary means also including a second section for maintaining said first section in said second position, said contact means being held open by said first section when the latter is in said second position, said second section being releaseable to permit said first section to return to said first position wherein said operating mechanism may close said contact means.

3. A circuit breaker contact as set forth in claim 1 in which the first section of the auxiliary means includes a solenoid having a coil and an armature movable from a first to a second position upon energization of said coil to act directly on the contact means for opening the latter responsive to receipt of said first control signal.

4. A circuit breaker contact as set forth in claim 3 in which the auxiliary means also includes a second section for maintaining said armature in said second position, said second section being selectively releaseable to permit said armature to return to said first position wherein said operating mechanism may close said contact means.

5. A circuit breaker contact as set forth in claim 4 in which the second section of the auxiliary means includes latch portion for holding the armature in said second position and solenoid energizable by a second control signal to release said armature responsive to receipt of a second control signal by said solenoid.

6. A circuit breaker contact as set forth in claim 3 in which the contact means includes a movable contact mounted at one end of a movable contact arm, said armature when in said second position operatively engaging said contact arm.

7. A circuit breaker contact as set forth in claim 6 in which the operating mechanism also includes an operating spring connected to said contact arm to act through the latter and bias said armature to said first position.

8. A circuit breaker contact as set forth in claim 7 in which the operating means also includes a releaseable cradle normally latched in a holding position and movable to a released position through operation of said trip means upon the occurrence of said predetermined fault current conditions, said operating spring biasing said cradle toward said released positions.

9. A circuit breaker contact as set forth in claim 8 in which the operating means includes a manually operable member supporting said contact arm at the other end thereof, said member normally being movable between contact CLOSED and full OPEN positions, with said armature in said second position said contact arm being in a position intermediate its contact closed and its fully open positions.

10. A circuit breaker contact as set forth in claim 1 also including a single insulating housing wherein said contact means, said operating mechanism, said automatic trip means and said auxiliary means are disposed.

* * * * *